US010631589B2

(12) United States Patent
Sun et al.

(10) Patent No.: US 10,631,589 B2
(45) Date of Patent: Apr. 28, 2020

(54) SKI BOOTS

(71) Applicant: BEIJING MKS RESEARCH INSTITUTE, Beijing (CN)

(72) Inventors: Yingui Sun, Beijing (CN); Hui Elizabeth Zhou, Beijing (CN); Shiguo Wang, Beijing (CN); Haipeng Li, Beijing (CN); Yunpeng Yan, Beijing (CN); Sai Zhang, Beijing (CN); Xinyue Zhang, Beijing (CN)

(73) Assignee: BEIJING MKS RESEARCH INSTITUTE, Beijing (CN)

( * ) Notice: Subject to any disclaimer, the term of this patent is extended or adjusted under 35 U.S.C. 154(b) by 236 days.

(21) Appl. No.: 15/580,953

(22) PCT Filed: May 16, 2017

(86) PCT No.: PCT/CN2017/084573
§ 371 (c)(1),
(2) Date: Dec. 8, 2017

(87) PCT Pub. No.: WO2018/166061
PCT Pub. Date: Sep. 20, 2018

(65) Prior Publication Data

US 2019/0380426 A1 Dec. 19, 2019

(30) Foreign Application Priority Data

Mar. 16, 2017 (WO) ..... PCT/CN2017/076921

(51) Int. Cl.
*A43B 5/04* (2006.01)
*A43B 3/00* (2006.01)
(Continued)

(52) U.S. Cl.
CPC ..... *A43B 5/0427* (2013.01); *A43B 3/0005* (2013.01); *A43B 3/06* (2013.01);
(Continued)

(58) Field of Classification Search
CPC ..... A43B 5/0427; A43B 5/04; A43B 3/0005; A43B 3/06; A43B 23/0295; A43C 11/165; A43C 11/18
See application file for complete search history.

(56) References Cited

U.S. PATENT DOCUMENTS 2,983,019 A * 5/1961 Rae ..... A43C 11/12 24/438
3,685,176 A 8/1972 Bogert
(Continued)

FOREIGN PATENT DOCUMENTS

CN 201015448 Y 2/2008
DE 20 2014 003 652 U1 3/2015
(Continued)

OTHER PUBLICATIONS

Korean Intellectual Property Office Notice of Allowance of Patent dated Aug. 6, 2019 issued in Korean Patent Application No. 10-2018-7003414.

*Primary Examiner* — Ted Kavanaugh
(74) *Attorney, Agent, or Firm* — Scully Scott Murphy & Presser

(57) ABSTRACT

The invention provides a shell including a left portion and a right portion which are able to switch between a translation open state in which they are separated from each other by a distance and a closed state in which they are closed with each other, wherein in the translation open state, the left portion and the right portion are able to pivot relative to each other, wherein the shell also includes a locking mechanism and a separation bias device, wherein the locking mechanism is configured to keep the shell in the closed state and is able to be released so as to allow the shell to be placed in the translation open state, and wherein the separation bias
(Continued)

device is configured to bias the left portion and the right portion toward the translation open state.

20 Claims, 15 Drawing Sheets

(51) Int. Cl.
*A43B 3/06* (2006.01)
*A43B 7/02* (2006.01)
*A43B 23/02* (2006.01)
*A43C 11/16* (2006.01)

(52) U.S. Cl.
CPC ..... *A43B 5/04* (2013.01); *A43B 5/0407* (2013.01); *A43B 7/02* (2013.01); *A43B 23/0295* (2013.01); *A43C 11/165* (2013.01)

(56) References Cited

U.S. PATENT DOCUMENTS 3,999,256 A * 12/1976 MacFee ..... A43C 11/12 24/438
4,094,029 A * 6/1978 Carlile ..... A43C 11/18 12/113
4,184,273 A * 1/1980 Boyer ..... A43B 3/02 36/118.2
4,551,933 A * 11/1985 Morell ..... A43B 5/0429 36/118.2
4,633,599 A 1/1987 Morell et al.
4,741,115 A 5/1988 Pozzobon
4,845,338 A * 7/1989 Lakic ..... A41D 19/001 219/211
5,878,378 A 3/1999 Brommer et al.
6,243,971 B1 * 6/2001 Hofft ..... A43C 11/08 24/438
7,793,438 B1 * 9/2010 Busse ..... A43B 11/02 36/105
2002/0029493 A1 * 3/2002 Baek ..... A43B 5/0407 36/29
2005/0016027 A1 1/2005 Trinkaus et al.
2011/0203139 A1 * 8/2011 Eidson ..... A43B 1/0054 36/103
2014/0373393 A1 12/2014 Tronchin et al.
2015/0216252 A1 * 8/2015 Wiens ..... A43B 1/0054 36/105
2016/0058130 A1 * 3/2016 Boney ..... A43C 1/06 24/712.6
2016/0150851 A1 6/2016 Lupinek et al.
2016/0157756 A1 6/2016 Yu et al.
2016/0192729 A1 7/2016 Rastello
2018/0110289 A1 * 4/2018 Owings ..... A43B 13/141
2018/0263332 A1 * 9/2018 Bruno ..... A43B 13/189

FOREIGN PATENT DOCUMENTS

FR 1 561 350 A 3/1969
FR 2 071 608 A5 9/1971
FR 2 646 061 A1 10/1990
JP S47-1274 A 1/1972
JP S48-73252 A 10/1973
JP S50-35857 Y 10/1975
JP H2-180201 A 7/1990
KR 10-1448426 B1 10/2014
KR 10-2015-0107737 A 9/2015

* cited by examiner

SKI BOOTS

The application claims the priority of a PCT application PCT/CN2017/076921 filed on Mar. 16, 2017, the entirety of which is herein incorporated by reference.

BACKGROUND

The disclosure relates to ski boots, in particular the ski boots for skiing.

Skiing is a popular sport in winter. The feet of the skier must be securely and rigidly fixed onto the skis by ski boots. When the feet move back and forth or left and right, they must be rigidly connected to the skis by the ski boots in order to effectively control the gesture, speed and direction so as to slide on the snowfield. In order to put on the skis, the soles of the ski boots are snapped onto the bindings of the skis. Additionally, in order to make the boots securely snap onto the skis, the boots should be able to support the body weight of the skier in all the four directions of front, rear, left and right. Therefore, the sole and upper of the boots are typically an integral part and relatively stiff. However, when the skier is walking before arriving at ski track or when he wants to go to washroom, drink, or eat, the rigid boots cause inconvenience to him, in particular, he has to suffer this inconvenience and waddles to the entrance of the ski track from the place he puts on the boots or returns to the changing room from the ski track. It is very difficult to temporarily leave the ski track during skiing.

In order to solve this inconvenience, DAHU SPORTS provides a ski boot, which comprises a liner and a shell. The shell constitutes the outside of the ski boot and comprises a sole and an upper. The sole is snapped to a ski. The upper is comprised of a forward portion and a rearward portion which can be pivotally connected so as to separate from each other so that the liner can be taken off or put into the shell. Therefore, when the skier wants to walk, he can open the forward and rearward portions of the shell and walk by the liners, thereby avoiding the above inconvenience. When skiing, the liner is put into the shell and the forward and rearward portions are fastened to each other by a locking clasp so as to make up a ski boot as rigid as a conventional ski boot.

Additionally, US patent application US2016/192729A1 discloses a ski boot system which includes a shell and a liner. The shell is made up of two side portions, that is, a left side portion and a right side portion, which are hinged together at a rear portion or at a sole portion by a hinge. Therefore, the shell can be opened at the hinge as an axis to take the liner out. Additionally, there is a locking clasp on the shell to keep the shell in a closed position.

However, there are some problems with these ski boots. In the boots from DAHU SPORTS, even though it is easy to open the forward and rearward portions of the shell by hands, it is hard to take the liner out of the shell, especially when the skier is wearing cumbersome ski gloves. In particular, it is hard to handle the locking claps back and forth since there is no space between the forward and rearward portions of the shell for keeping the entire stability and thus they form tight fitting dimensions. Therefore the liner is hard to put into or get out of the shell.

And in the ski boots disclosed by US patent application US2016/192729A1, in case that the hinge is installed at the rear portion of the shell, the strength of the entire boot is weakened to the extent that the controllability is reduced. And in case that the hinge is installed at the sole, it is hard to open it in operation. In particular, the hinge portion has to project inwardly so as to get separated when the ski is tearing from the front portion of the boot, therefore it is hard to separate, resulting in the difficulty in putting the liner into the shell or getting it out therefrom. More importantly, when the left and right side portions are to be closed, the liner must be caught therebetween so that they cannot be closed. In same way, when the hinge is installed on the sole, in addition to the above problem, the left and right side portions can hardly be well closed due to the support of the hinge. Hence this solution is not practical. Therefore, this solution has not been commercialized since it came out during 1970s.

In addition, U.S. Pat. No. 4,633,599 discloses a ski boot, the rear upper of which can be opened rearward. Then the rear upper can be pressed against the leg of the skier by means of an elastic cable. One end of the elastic cable is fixed onto the rear upper and the other end is fixed onto locking means. The locking means have a form of knob and can be rotated manually so as to adjust the tension applied to the elastic cable. However, the locking means can only apply a force onto the elastic cable which is too small to securely hold the pivotal rear upper in a proper position. Furthermore, due to the installation position and the structure of the knob, it is hard to increase the locking force of the locking means by way of increasing the diameter of the knob.

There are still some technical solutions for tensioning the belts in the prior art. For example, Chinese Utility Model CN201015448Y discloses a belt reel which is composed of a cylinder seat, a winding shaft, a limiting cylinder and a driving shaft. The belt is wound around the winding shaft and can be driven by the driving shaft. The driving shaft has a ratchet wheel so as to engage with the ratchet. And the driving shaft can be pulled axially so as to slide between the position in which it engages with the teeth and the position in which it disengages from them. And the driving shaft can be rotated by the controlling cylinder so as to wind or unwind the belt. Such technical solutions utilizing knobs are applicable on normal shoes. However, just as mentioned before, since they cannot provide large tension to the belts, they cannot be applied on the ski boots which require large tension or even regular ski boots; moreover they cannot be applied on the ski boots with a shell covering a liner. That is because the locking required by the ski boots is different from that of normal shoes which only needs to overcome the elastic space of the socks or fillers inside the shoes. For ski boots with separated liner and shell, it is more critical that it should not only overcome the need of multidirectional forces of the boot, especially when there is high rigidity and when the sole and the shell are overlapped; it should also overcome locating pins at multiple positions, friction and support of various springs; furthermore, it should be easy to lock so that there is no space and the locking is secure.

In addition, since skiing is a kind of dangerous sports, especially during alpine skiing or off-ski track skiing, the skier can be in danger due to his own fault or the change of outside conditions. And in some extreme situations, the skier may lose unconsciousness. If the distress signal is failed to send out and rescue is not available in time, there is a risk of huge blood loss or freezing to death of the skier. However, due to the strict natural conditions of the ski park, search and rescue operation is hard.

Therefore, there is a need to improve the ski boots.

SUMMARY

The object of the invention is to solve or at least relieve the problems in the prior art and provides a separable ski boot for skis. It is constituted by inserting a flexible liner into a rigid boot shell.

According to one aspect of the invention, the shell including a left portion and a right portion which are able to switch between a translation open state in which they are separated from each other by a distance and a closed state in which they are closed with each other, wherein in the translation open state, the left portion and the right portion are able to pivot relative to each other, wherein the shell also includes a locking mechanism and a separation bias device, wherein the locking mechanism is configured to keep the shell in the closed state and is able to be released so as to allow the shell to be placed in the translation open state, and wherein the separation bias device is configured to bias the left portion and the right portion toward the translation open state.

Thanks to the invention, the shell can be conveniently place into the open state so that the liner can be easily taken out of the shell, making the skier walking easily. Also when needed, the liner may be easily inserted into the shell and the shell is locked so that the ski boot is used as if they are used as normal ski boots for skis.

According to another aspect of the invention, the shell including a left portion and a right portion which are able to switch between a translation open state in which they are separated from each other by a distance and a closed state in which they are closed with each other, wherein in the translation open state, the left portion and the right portion are able to pivot relative to each other, wherein the shell also includes a locking mechanism and a separation bias device, wherein the locking mechanism is configured to keep the shell in the closed state and is able to be released so as to allow the shell to be placed in the translation open state, wherein the separation bias device is configured to bias the left portion and the right portion toward the translation open state, and wherein a plurality of inflatable air bags are provided inside the shell.

By providing air bags inside the shell, the air bags may be inflated so as to fit the size of the skier's foot. Thus the need for a liner for the ski boot is omitted. The skier may put on the shell without wearing shoes or even with normal shoes worn. By inflation of the air bags, the shell snugly fits the foot or shoe of the skier. The skier may immediately start skiing.

BRIEF DESCRIPTION OF THE DRAWINGS

The above and other features, advantages and technical superiority can be understood in light of the detailed description of preferred embodiments of the invention with reference to the drawings, in which.

DETAILED DESCRIPTION

Now preferred embodiments of the invention will be explained with reference to the drawings. It should be noted that the description is illustrative and by no means limiting. The skilled in the art will understand that the invention can be implemented by various ways and is not limited to the preferred embodiments described here.

In the following description, the terms regarding directions such as "front", "rear", "left" and "right" are defined based on orientations when a ski boot of the left foot is placed as in FIG. 3, that is, when the observer face to heel: the left and right directions are what the observer views as left and right; the front direction is the direction from the heel to the toe cap; the rear direction is opposite to the front direction; and the inward and outward directions are the direction pointing to the outside and the direction pointing to the inside. Obviously, these definitions are simply for the purpose of better illustrating the invention. The invention is not limited to them. For the ski boot for the right food, the left and right directions are inverted. Additionally, in the present application, the ski boot for the left foot is described as an example. However, it is clear that the same description can be equally applied to the ski boot for the right foot.

As used in the invention, the usage of "one embodiment" or "this embodiment" is not intended to mean that the features described in one embodiment can only be used in this embodiment. Rather, the features in one embodiment can also be used in other embodiments or combine with the features in other embodiments so as to create a new embodiment.

The Overall Structure of a Ski Boot

Figure 1:
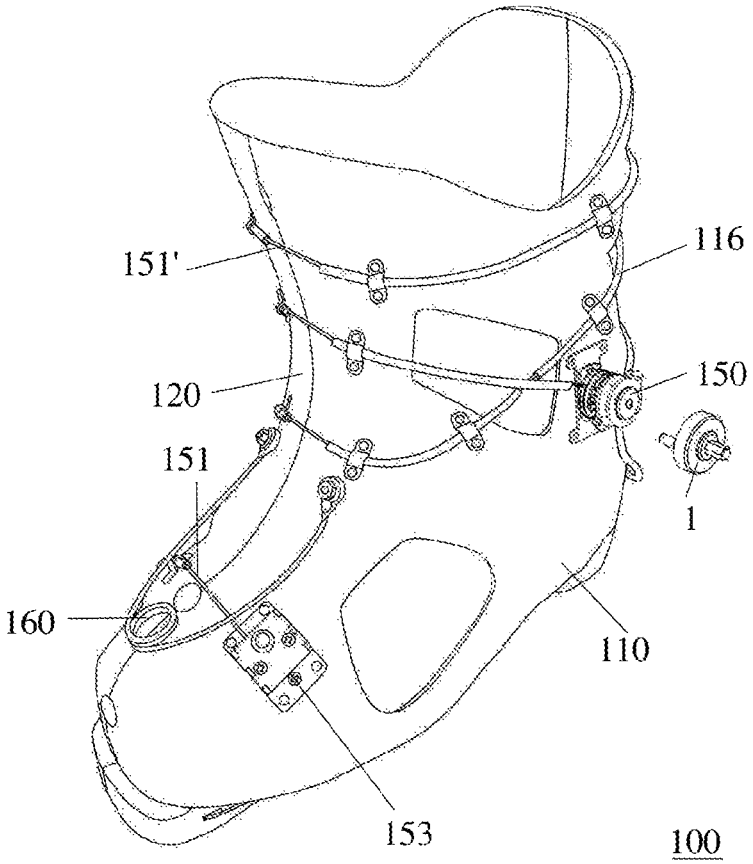
FIG. 1 shows a perspective view of a shell for a ski boot according to an embodiment of the invention.
Figure 2:
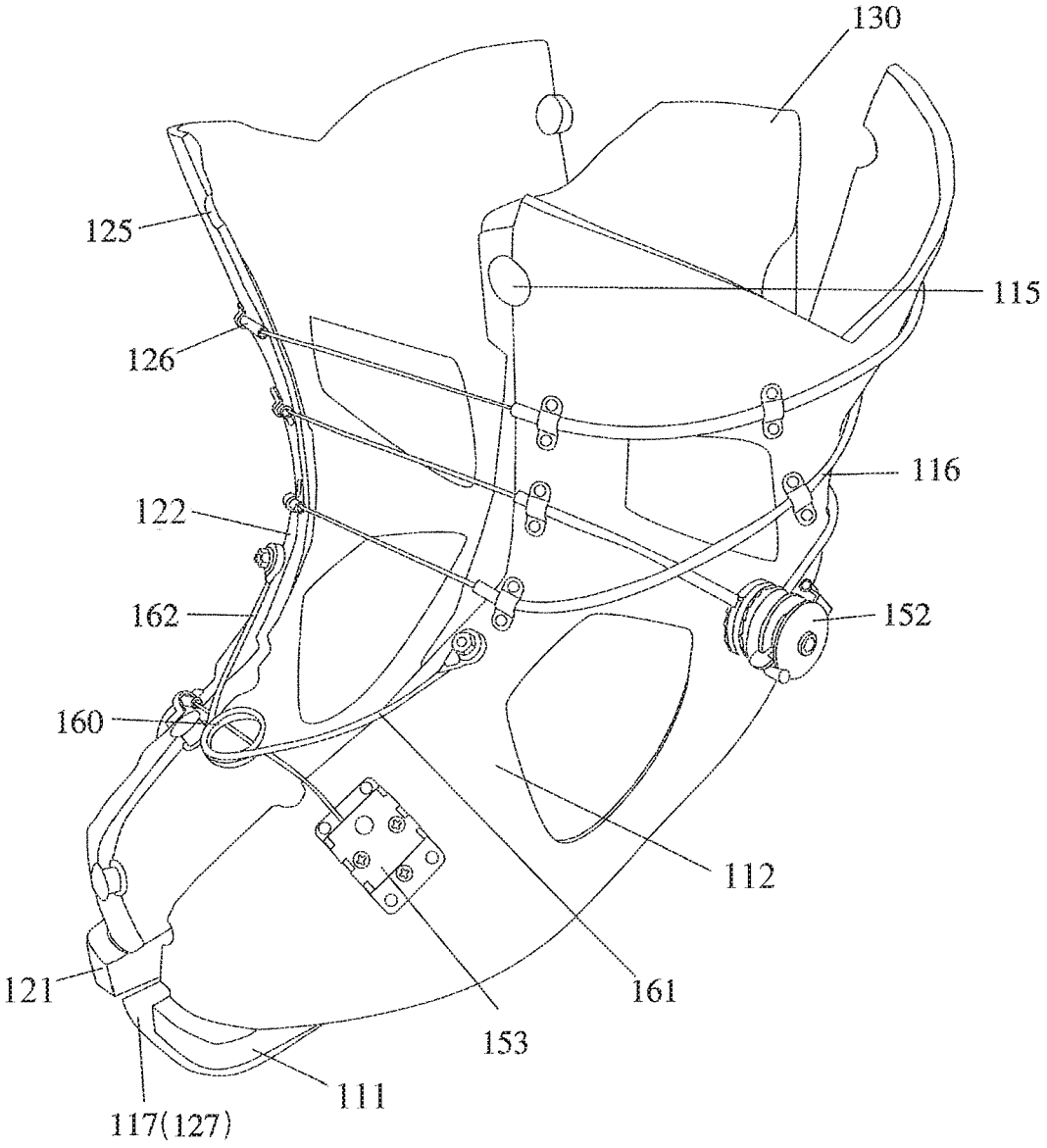
FIG. 2 shows a perspective view of the shell in FIG. 1 in separated state.

Now the overall structure of the ski boot according to the invention will be explained with reference to FIGS. 1 to 4. FIG. 1 shows a perspective view of a shell of the ski boot according to an embodiment of the invention. As shown in FIG. 1, a shell 100 is designed to be rigid so that it can accommodate a liner 200 (FIG. 4). The shell 100 itself may be made of rigid synthetic materials. It has relatively big holes so that it can be lighter and the liner 200 is visible after the liner 200 is put into. However, the holes can also be omitted.

the shell 100 is sized such that the liner can be put into it and take out therefrom and the shell and the liner can combine with each other to form a ski boot. As shown in FIGS. 1 and 2, the shell 100 includes a left portion 110 and a right portion 120 which can be in an open state in which they are separated from each other by a distance and can be in a closed state in which they are engaged with each other.

The left portion 110 includes a sole left portion 111 and an upper left portion 112. The right portion 120 includes a sole right portion 121 and an upper right portion 122. In addition, the shell also includes an upper rear portion 130 and a locking mechanism 150.

Figure 3:
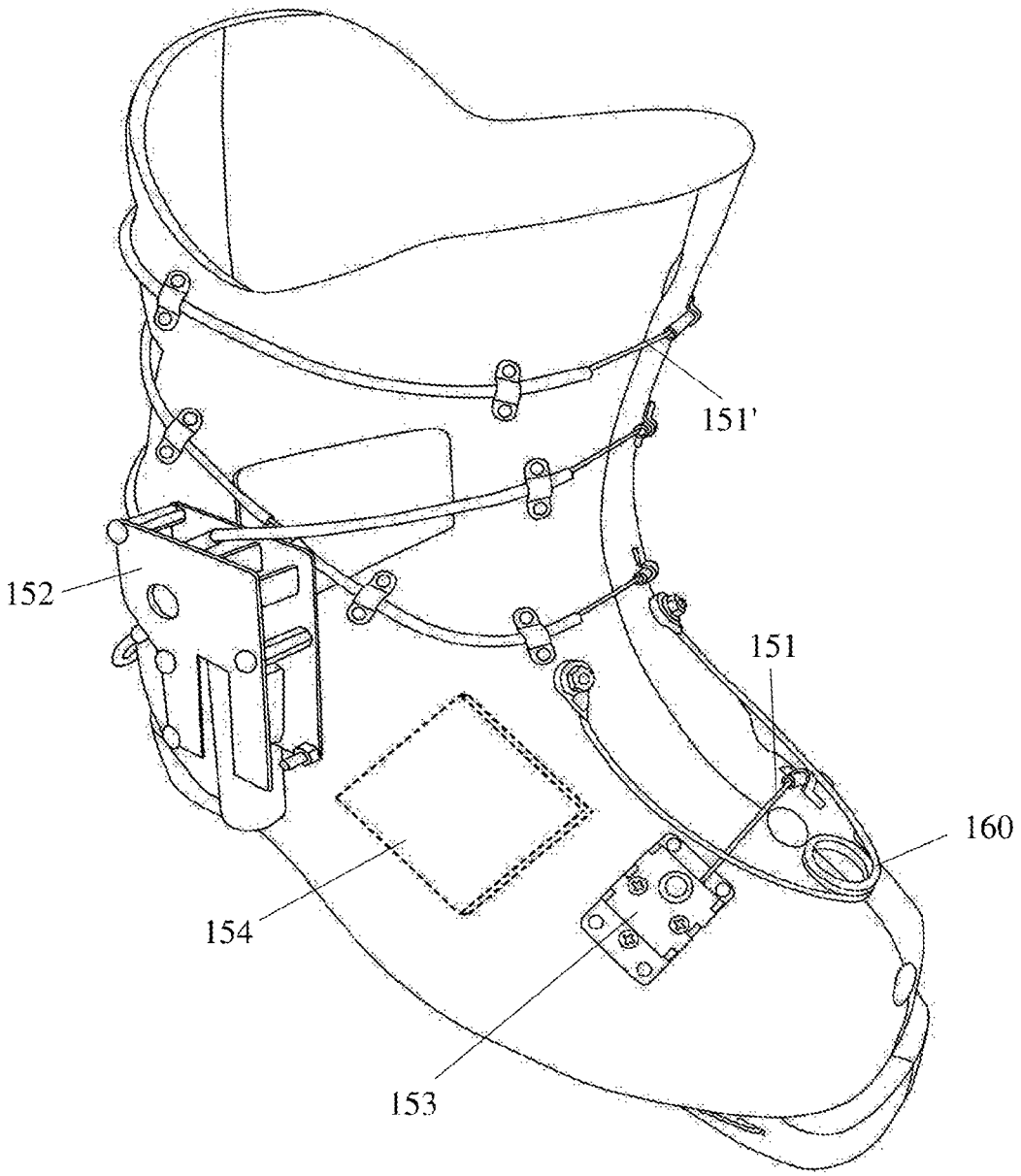
FIG. 3 shows a perspective view of a shell for a ski boot according to the embodiment of the invention, in which an electric lock is adopted.
Figure 4:
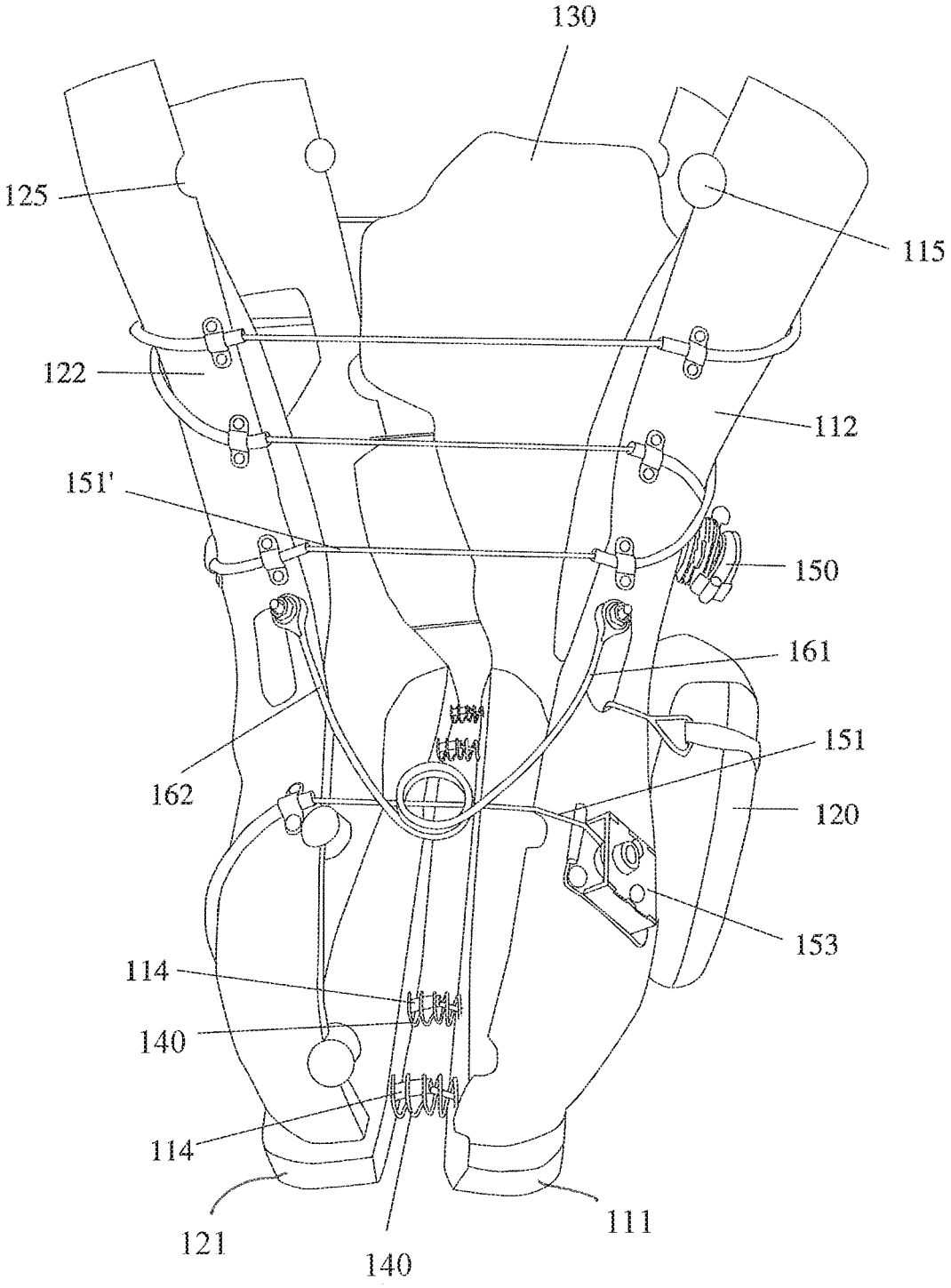
FIG. 4 shows a perspective view of the shell in FIG. 1 in separated state, which is in a different view from FIG. 2.

As shown in FIGS. 3 and 4, the sole left portion 111 and the upper left portion 112 are for example made of synthetic material in one piece, and the sole right portion 121 and the upper right portion 122 are for example made of synthetic material in one piece.

There are a plurality of elastic connection members 140 provided between the sole left portion 111 and the sole right portion 121, such as sole springs. The sole springs perform several functions, for example as mentioned below, the sole springs are capable of bouncing the sole left portion 111 and the sole right portion 121 away from each other by a distance when the locking mechanism releases, and preventing the sole left portion 111 and the sole right portion 121 from disengaging completely at the same time, and permitting the sole left portion 111 and the upper left portion 112 thereon rotating relative to the sole right portion 121 and the upper right portion 122 thereon so that the shell 100 opens at a large angle (acting like a hinge). Also, the elastic connection members 140 performs the function of guiding and positioning the sole left portion 111 and the sole right portion 121 to be closed with each other. Although shown as coil springs in the figures, elastic members that can perform similar functions, such as rubber elastic members, can be used as well. Four sole springs are shown in the figures, it is clear that the invention is not limited to the particular number of sole springs.

Additionally, there is an upper separation member 160 provided between the upper left portion 112 and the upper right portion 122, such as an upper separation spring. As shown, the upper separation spring 160 is arranged between toe cap portions of the upper left portion 112 and the upper right portion 122 and is shown as a torsion spring. The two legs 161 and 162 of the torsion spring 160 are fixed on the upper left portion 112 and the upper right portion 122 respectively, so as to bias the upper left portion 112 and the upper right portion 122 toward the open state.

In order to guarantee the precise engagement between the left portion 110 and the right portion 120 of the shell 100, there are locating members arranged between the left portion 110 and the right portion 120.

In detail, as shown, a plurality of through holes (not shown) are formed in the sole left portion 111 and the sole right portion 121 along the transverse direction of the sole. Pins 114, preferably hollow, penetrate into the holes formed in one of the sole left portion 111 and the sole right portion 121. Hollow sleeves (not shown) are provided in the corresponding holes formed in the other of the sole left portion 111 and the sole right portion 121 so as to cooperate with the pins 114. Thus, when the sole left portion 111 and the sole right portion 121 are cooperated with each other, the pins 114 may penetrate into the sleeves so as to guarantee the correct alignment of the two portions of the shell. Additionally, as shown, the sole springs 150 are nested on the pins 114 and the sleeves. By means of the springs and locating members arranged as such, the number of holes formed on the sole left portion 111 and the sole right portion 121 can be reduced so as to avoid the weakening of sole strength and save manufacture cost.

In addition, a plurality of locating members are formed on the edges of the upper left portion 112 and the upper right portion 122 cooperated with each other as well. As shown, the locating members include circular projections 115 formed at a plurality of positions on the edge of the upper left portion 112 and semi-circular recesses 125 formed at corresponding positions on the upper right portion 122. When the upper left portion 112 and the upper right portion 122 are cooperated with each other, the circular projections 115 are engaged into the recesses 125 so as to guarantee the precise locating of the upper left portion 112 and the upper right portion 122. However, the positions of the projections and the recesses can be exchanged.

A baffle 117 or 127 is provided on the sole left portion 111 or the sole right portion 121 as well. The baffle 117 or 127 extends in the lengthwise direction of the sole left portion 111 or the sole right portion 121 and is arranged at the boundary between the sole left portion 111 and the sole right portion 121 so as to block the gap between the sole left portion 111 and the sole right portion 121. By arranging the baffle 117 or 127, snow or water can be prevented from penetrating into the shell through the gap between the sole left portion 111 and the sole right portion 121.

The shell is provided with a locking mechanism 150. The locking mechanism 150 is arranged at a position near the ankle on the upper left portion 112.

As shown in FIGS. 2, 4 and 7, the locking mechanism 150 includes a cord 151 and 151' and a lock 152.

One end of the cord 151 is fixed at the position near the toe cap on the upper left portion by an adjuster 153 and extends from that position in an inclined downward direction to the guiding channels 113 and 123 formed in the sole right portion. Through the guiding channels 113 and 123, it extends across the boundary edge between the sole left portion and sole right portion several times and finally extends in an inclined upward direction to a slot of the lock 152 for the cord 151. Similarly, the cord 151' starts from an adjuster 154, winds around the front and right of the upper left portion and upper right portion, and then arrives at a slot of the lock 152 for the cord 151'. As explained above, the guiding channels 113 and 123 of the sole left portion 111 and the sole right portion 112 that the cord 151 goes through are same with the through holes of the locating members arranged above, so that the cord 151 goes through the hollow pins 114 and the sleeves 124. Therefore, the number of holes made in the sole left portion and sole right portion is reduced and the manufacture cost is also decreased. However, it is obvious that separate guiding channels can be arranged for the cord 151. In addition, pulleys are provided at the entrance and exit of each guiding channels 113 and 123 so as to reduce the resistance when pulling the cord 51.

In addition, optionally, the diameter of the slot for cord 151 and the diameter of the slot for cord 151' may be designed so as to be different from each other so that the cords 151 and 151' can be tensioned at the same time. This is because the lengths that cord 151 and cord 151' need to be wound may be different when the shell 100 is being closed.

In addition, optionally, in order to coordinate the progress of winding the upper cord and the sole cord, three slots may be arranged on the lock. Among these three slots, the diameter of the slot for the upper cord is larger than the diameters of the other two slots for sole cord. And the upper cord 151' is introduced into the slot for the upper cord from both sides so that during winding the cord is wound in the slot from both sides at the same time and the cord is overlapped with each other, which rapidly increases the diameter of the slot, resulting in the further pulling of the cord. Two ends of the sole cord are wound in each of the slots with smaller diameters respectively without overlapping. Therefore, it is pulled tight with a speed lower than that of the upper cord. Hence the sole cord and the upper cord are pulled tight almost at the same time, placing the shell into the closed state.

Additionally or alternatively, as mentioned above, the cords 151 or 151' may be wound in or paid out as necessary by providing an adjuster 153. For example, when a skier with slim ankles or shins puts on the shell 100, spare cord 151' can be wound in by the adjuster 153 so as to shorten the cord 151'. Therefore, when the locking mechanism 150 is in operation, the sole and the upper can be pulled tight simultaneously. But in case of a skier with thicker shins, the cord 151' can be released by the adjuster 153 so as to achieve the effect of pulling the sole cord 151 and the upper cord 151' tight simultaneously.

Moreover, in order to guide the upper cord 151', conduits 116 and 126 are provided at proper positions on the upper left portion 112 and upper right portion 122 so as to prevent tangling of the cord 161 during pulling tight and releasing and make sure that the cord 151' can be pulled smoothly.

The cords may be made of high strength nylon or carbon fibre for example.

As shown in FIGS. 2 and 4, an upper rear portion 130 is articulated at a position on the upper left portion 112 near the sole. When the upper left portion 112 and the upper right portion 122 are closed, the upper rear portion 130 is located at the medial of the lateral formed by the upper left portion 112 and the upper right portion 122 so as to facilitate the putting on and taking off of the liner.

The Structure of the Adjuster

Figure 6A:
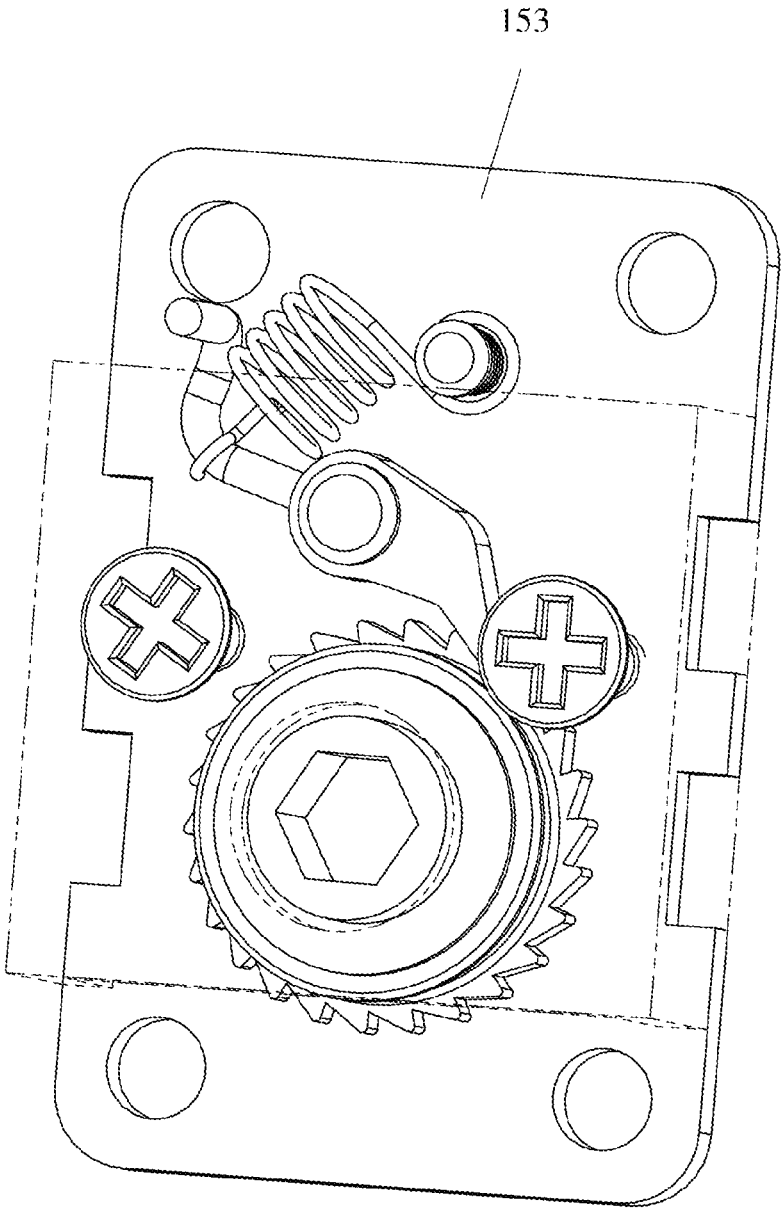
FIGS. 6A and 6B show a front view and an exploded view of an adjuster of the shell according to an embodiment of the invention respectively.
Figure 6B:
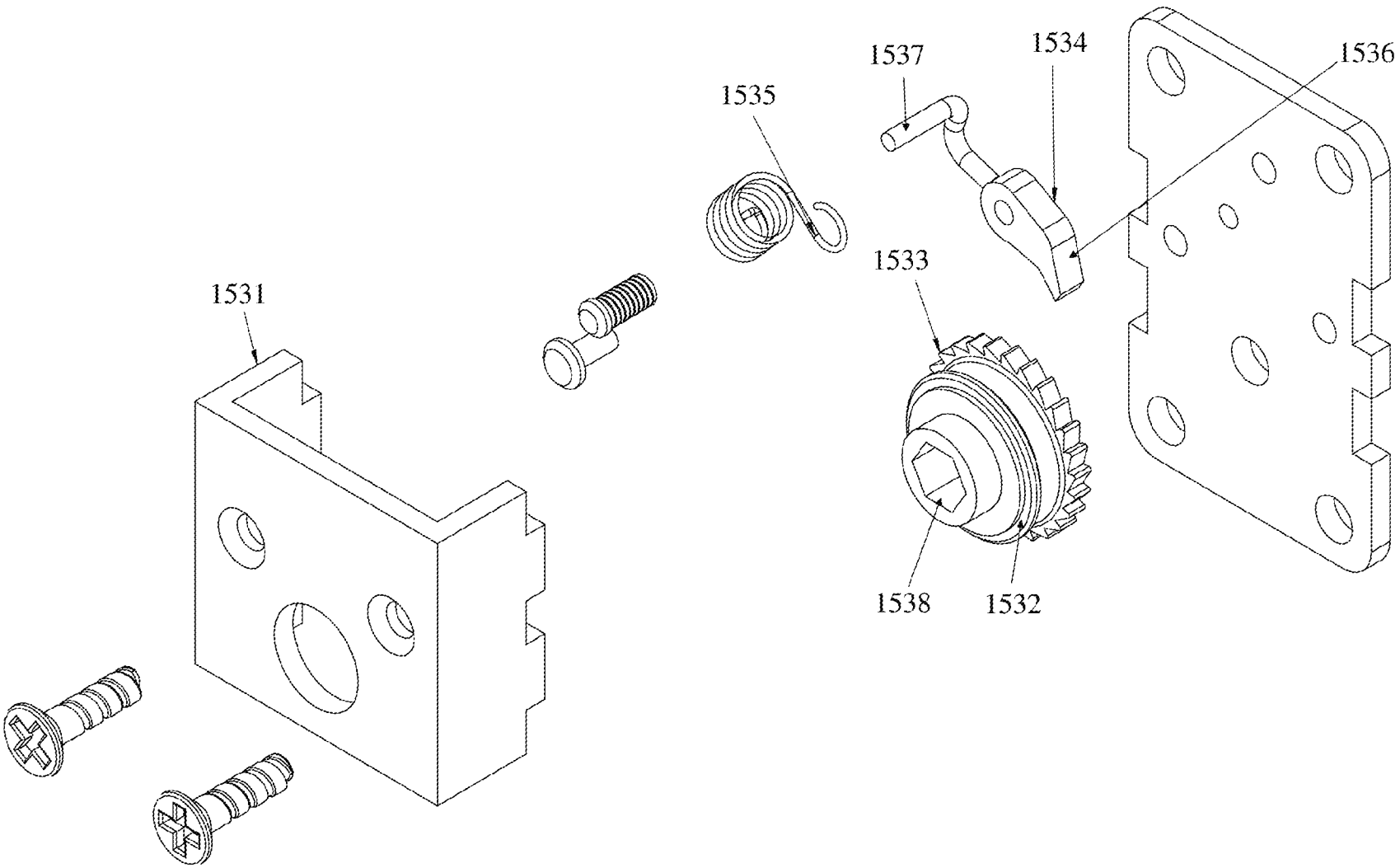

The structure of the adjuster will be explained with reference to FIGS. 6A and 6B below.

The adjuster 153 includes a casing 1531 fixed on the upper left portion 112 or the upper right portion 122, a slot 1532 rotatably arranged on the casing 1531, a ratchet 1533 formed on the external periphery of the slot 1532, a pawl 1534 which is biased so as to engage with the ratchet 1533, a biasing device that biases the pawl 1534 toward the direction of engaging with the ratchet 1533, such as a spring. The pawl 1534 is pivotally arranged on the casing 1531, and includes a tip portion 1536 which is engaged with the ratchet 1533 and a release end 1537 which is opposite to the tip portion 1536. One end of the spring 1535 is fixed on the casing 1531 and the other end is fixed near the release end 1537 so as to pull the release end 1537, making the pawl 1534 rotate in a clockwise direction and engaging the tip portion 1536 with the ratchet 1533. The end of the slot 1532 projecting out of the casing 1531 is provided with a socket 1538 so that a tool (not shown) can be inserted to rotate the slot 1532. When the cord 151 or 151' is too long, a tool, such as a driver, may be inserted into the socket 1538 so as to rotate the slot 1532 to wind the extra-long cord 151 or 151'. Due to the one-way feature during the rotation of the ratchet and the pawl, the slot can only be rotated in the direction of winding the cord. When the cord 151 or 151' is too short so that the cord should be released for a certain length, a tool (not shown) may be used to move the release end 1537 so that the pawl 1534 is rotated in an anti-clockwise direction, resulting in the disengagement of the tip portion 1536 of the pawl with the ratchet 1533. Therefore, the slot 1532 can rotate freely to release the cord by pulling the cord.

The Structure and Operation of the Lock

Figure 7A:
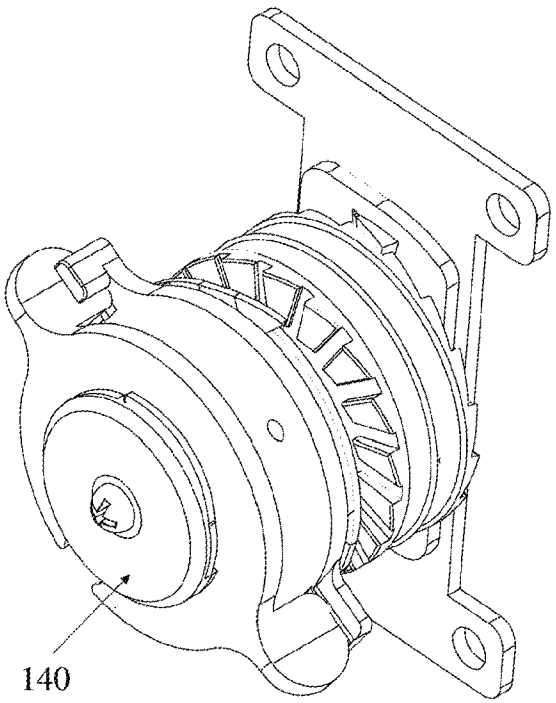
FIG. 7A shows a perspective view of the first implementation of the lock of the invention.
Figure 7B:
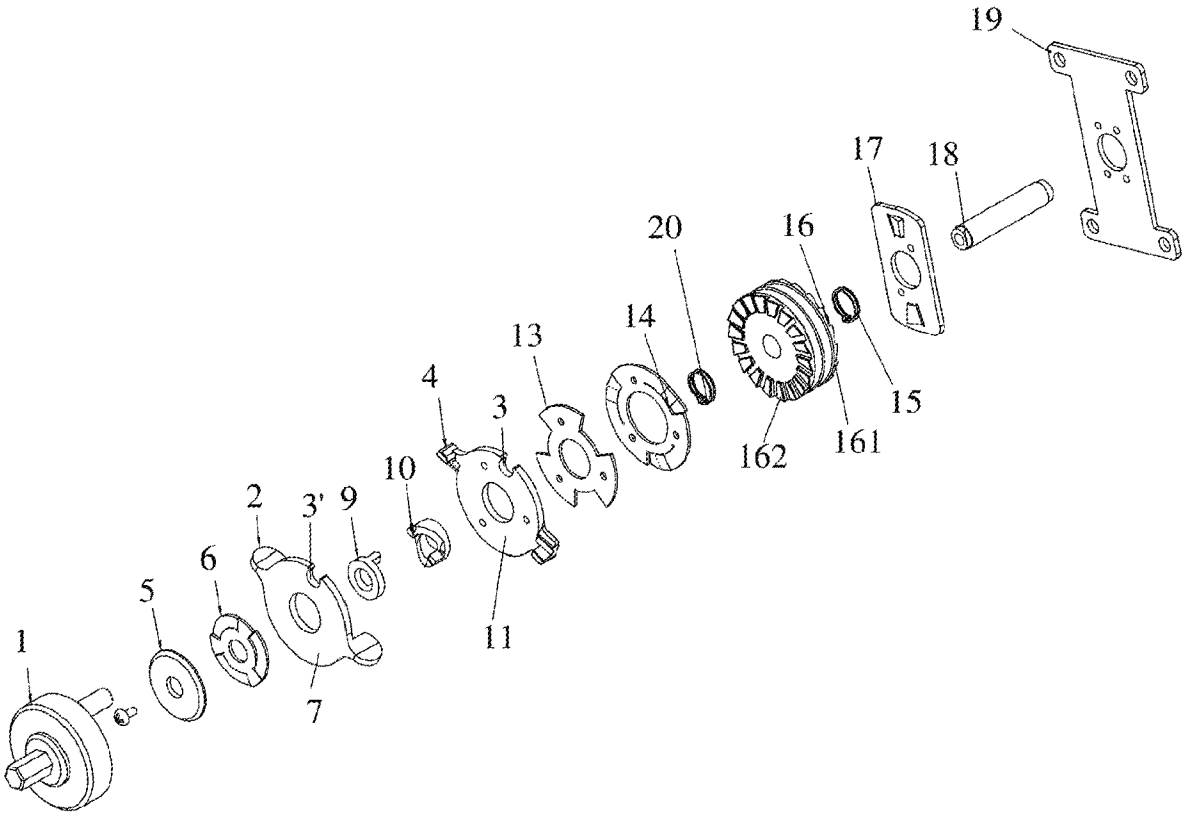
FIG. 7B is an exploded view of the lock of FIG. 7A.

The first implementation of the lock 152 will be explained with reference to FIGS. 7A and 7B below.

The lock 152 is fixed on the upper left portion 112 or the upper right portion 122 by a bracket 19, depending on the particular design. The lock 152 also includes a shaft 18 fixed on the bracket 19 and, successively fitted on the shaft, an inner locking plate 17, a separation spring 15, a double-sided ratchet wheel 16, a clutch spring 20, an outer locking plate 14, a profiled washer 13, an inner baffle 11, a cam 10, a cam follower 9, a driving plate 7, a damping spring 6, a washer 5, a cover 2 and a locking screw 1. The inner locking plate 17 is fixed relative to the bracket 19 and is provided with a pawl (not referenced) which is selectively engaged with inner ratchet 161 of the double-sided ratchet wheel 16. The separation spring 15 is provided between the double-sided ratchet wheel 16 and the inner locking plate 17 and bias the double-sided ratchet wheel outwardly, that is, biasing the double-sided ratchet wheel 16 in the direction of disengaging the inner ratchet 161 of the double-sided ratchet wheel 16 from the pawl of the inner locking plate 17. The double-sided ratchet wheel 16 has ratchets on the two opposite sides, that is, the above-mentioned inner ratchet 161 and an outer ratchet 162. The inner ratchet 161 and the outer ratchet 162 incline toward a same direction, that is, when engaging with a corresponding pawl, the ratchet wheel can only rotate in one and the same direction. It is rotatable and is axially slidably fitted on the shaft 18. The slot (not referenced) in which the cord 151 or 151' can be wound in is formed integrally with the double-sided ratchet wheel 16.

The clutch spring 20, outer locking plate 14, profiled washer 13 and inner baffle 11, which may be rotated outwardly and axially slided, are successively fitted on the shaft 18. The outer locking plate 14, profiled washer 13 and inner baffle 11 are fixed together by means of rivets or welding for example. The outer locking plate 14 has pawls which can selectively engage with the outer ratchet 162 of the double-sided ratchet wheel 16, for example three pawls. Those pawls are punched out directly from the outer locking plate 14. The profiled washer 13 has three indents on the circumference which correspond to the three pawls of the outer locking plate 14, so as to provide space for the elastic deformation of the pawls.

The inner baffle 11 includes blocks 4 opposite provided on the external periphery and a driving notch 3 provided on the external periphery.

The cam 10 is fixed at the outside of the inner baffle 11. The cam 10 is fixed on it for example by welding. A driving plate 7 is placed immediately adjacent to the inner baffle 11. The cam follower 9 is fixed on the driving plate 7 for example by welding and placed against the surface of the cam 10.

Lugs 2 are provided at diametrically opposite positions on the external periphery of the driving plate 7 so as to be gripped by an operator. A driving notch 3' is provided on the external periphery of the driving plate 7. The shape of the driving notch 3' is same with that of the driving notch 3 of the inner baffle 11. The damping spring 6 and the cover 5 are provided outside the driving plate 7. The cover 5 is connected onto the shaft 18 by screws (not referenced) so as to prevent all the parts of the lock falling off the shaft 18.

Figure 7C:
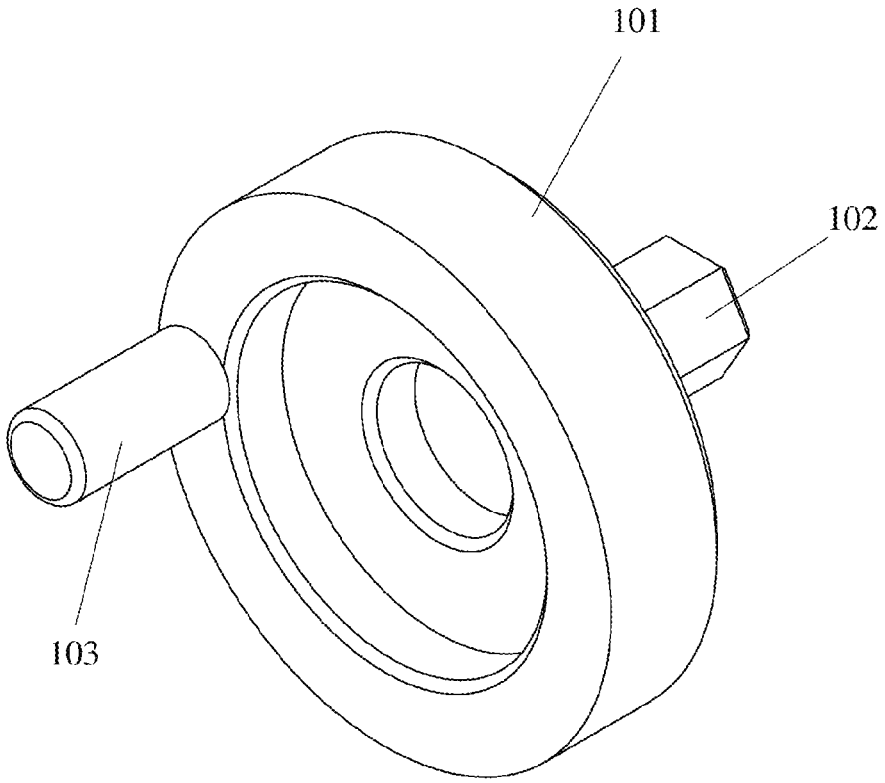
FIG. 7C shows a driving tool for the lock.

When the cord 151 or 151' is to be wound so as to place the shell 100 into the closed state, at first, for example, the driving plate 7 is rotated by gripping the two lugs 2 thereon until the two lugs 2 are rested against the two blocks 4 on the inner baffle 11. At this time, the driving notch 3' on the driving plate 7 aligns with the driving notch 3 on the inner baffle 11. The rotation of the driving plate 7 brings the cam follower 9 to slide on the cam 10, pushing the cam 10 internally in the axial direction. The pushing makes the cam 10 and the inner baffle 11 connected therewith overcome the elastic forces of the separation spring 15 and the clutch spring 20 and move internally so that the pawl on the outer locking plate 14 engages with the outer ratchet 162 of the double-sided ratchet wheel 16 and the pawl on the inner locking plate 17 engages with the inner ratchet 161 of the double-sided ratchet wheel 16. Therefore the double-sided ratchet wheel 16 can only rotate in one direction, that is, in the direction of winding the cord 15 or 15'. Now as shown in FIG. 7C, the driving tool 1 includes a body 101 in form of a round cover, a connecting head 102 formed on one side of the body for example in form of a hexagonal cylinder 102 and a driving pin 103 formed on the circumference of the other side of the body. The dimension of the driving pin 103 is equal or slightly smaller than the dimensions of the driving notches 3, 3'. By putting the body 101 of the driving tool 1 on the cover 5 of the lock and at the same time inserting the driving pin 103 into the driving notches 3, 3' aligned with each other, by means of an electric, pneumatic or manual driver connecting with the connecting head 102 of the driving tool 1 so as rotate the driving tool 1, the driving plate 7, inner baffle 11, inner locking plate 14 and the double-sided ratchet wheel 16 are driven into rotation. Therefore the cord 15 or 15' is wound in and pulled tight, and then the shell 100 is placed in the closed state. When the shell 100 is to be placed in the open state so as to take the liner 200 out of the shell 100, the driving plate 7 is rotated in an opposite direction. Then pushing of the cam follower 9 on the cam 10 is released. Under the effects of the separation spring 15 and the clutch spring 20, the pawl of the inner locking plate 17 is disengaged from the inner ratchet 161 of the double-sided ratchet wheel 16 and the pawl of the outer locking plate 14 is disengaged from the outer ratchet 161 of the double-sided ratchet wheel 16. Therefore, the double-sided ratchet wheel 16 is in a freely-rotating state, releasing the tension to the cord 151 or 151'. Under the actions of the sole springs 150 and the upper separation member 160, the left portion 110 and the right portion 120 are separated so that the shell is in the open state.

It should be pointed out that the external driver 180 may be a manual tool or may be an electric driven tool or a pneumatic driven tool, etc. The invention is not limited to it. Additionally, the external driver 180 may also be fixed on the left or right upper portions by clasps or loops, etc. formed on the left or right upper portions so as to be portable, as shown in FIG. 4.

The second implementation of the lock 152 will be explained with reference to FIGS. 8A and 8B below.

Figure 8A:
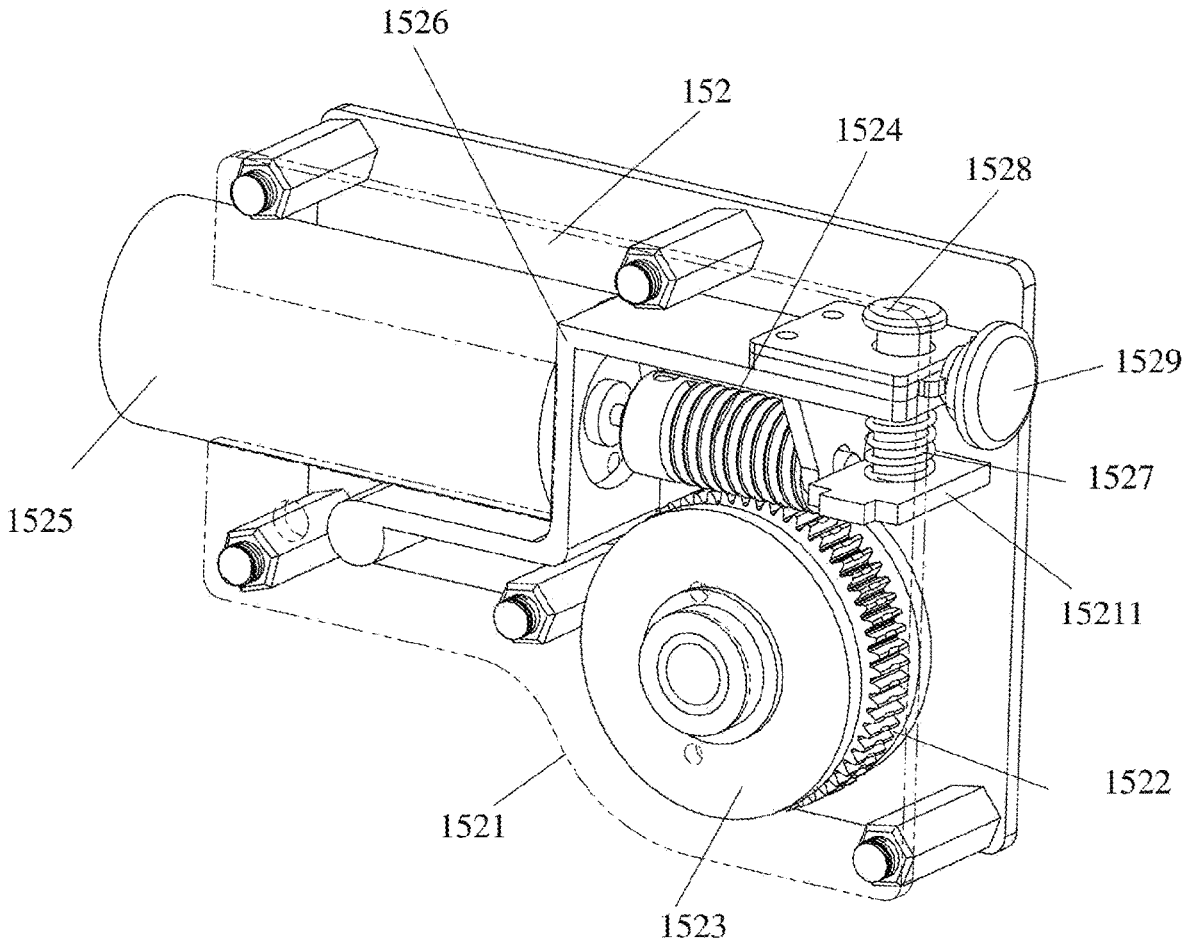
FIGS. 8A and 8B show a perspective view and an exploded view of the second implementation of the lock of the invention respectively.
Figure 8B:
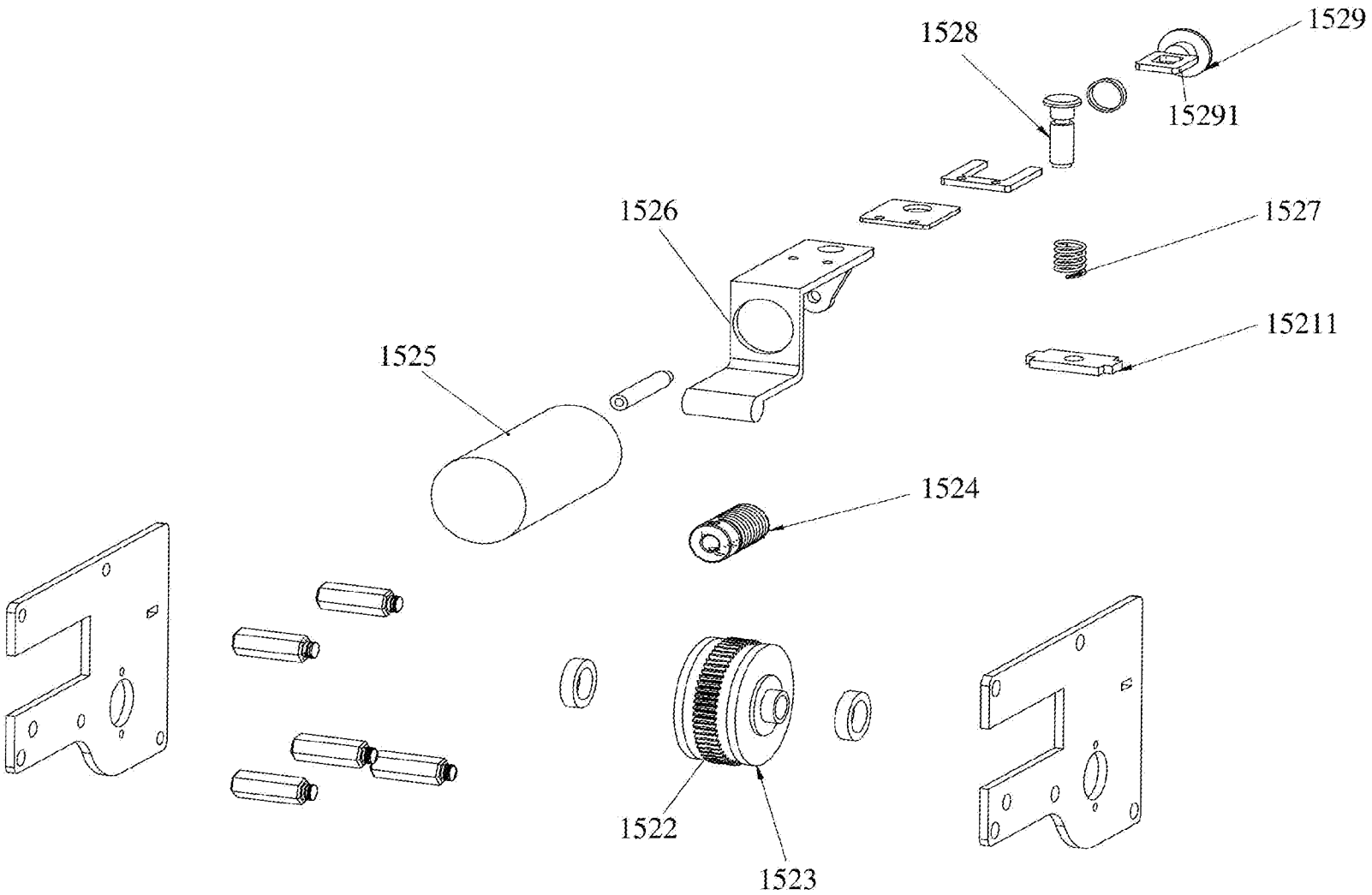

As shown in FIGS. 8A and 8B, the lock 152 includes a housing 1521 fixed on the upper left portion 112 or upper right portion 122, a worm gear 1522 rotatably arranged on the housing 1521, a slot 1523 which is integral with the worm gear 1522 and on which the cord 151 or 151' is wound, a worm 1524 engaging with the worm gear 1522 so as to drive it into rotation, a driver driving the worm in rotation such as a motor 1525, a switch (not shown) permitting power supply to the driver 1525 so that the driver 1525 drives the worm 1524 in rotation, and a release mechanism of the engagement between the worm 1524 and the worm gear 1522. The release mechanism includes a bracket 1526 in form of a substantially "Z" shape. One end of the bracket 1526 is swingably connected to the housing 1526; a hole is formed at the other end of the bracket 1526 so that the end of the worm 1524 that is not connected with the motor 1525 is inserted into the hole and may rotate within the hole. The release mechanism also includes a spring 1527 which biases the bracket 1526 so that the worm 1524 is away from the worm gear 1522, that is, the worm 1524 moves without engaging with the worm gear 1522. The release mechanism also includes a retaining mechanism which can retain the bracket 1526 in a position where the worm wheel 1522 and the worm 1524 engage. The retaining mechanism includes a pivot pin 1528 and a trigger button 1529. The pivot pin 1528 is fixed on a tab 15211 projecting from the bracket 1521 and the spring 1527 is wound on the pivot pin 1528 so that the spring 1628 is compressed between the tab 15211 and the bracket 1526. A recess is provided on the outer periphery of the pivot pin 1528. A tab 15291 is formed on the trigger button 1529 and has a hole through which the pivot pin 1528 passes. The trigger button 1529 is biased for example by a spring (not shown) so that the tab 15291 is caught within the recess of the pivot pin 1528. The tab 15291 is arranged outside the bracket 1526 so as to prevent the bracket 1526 from being pushed by the spring 1528. Furthermore, the lock 152 also includes a power supply, such as a battery which may be rechargeable so that it can be recharged when depletion. Alternatively, the battery may be a disposable battery that can be replaced when depletion.

The operation of the second implementation of the lock 152 will be explained below.

When pulling the cords 151 and 151' tightly so as to place the shell into the closed state, the button is pressed so as to supply the motor 1525. The motor 1525 drives the worm 1524 into rotation so as to drive the worm gear 1522 in rotation. The rotation of the worm gear 1522 causes the slot integral therewith to have the cords 151 and 151' wound in. When the shell 100 is to be placed in the open state, the trigger button 1529 is pressed so that the tab 15291 of the trigger button 1529 gets out of the recess of the pivot pin 1528. Thus, the tab 15291 can slide on the pivot pin 1528. By way of this, the blocking of the bracket 1526 by the tab 15291 is released. The bracket 1526 swings under the action of the spring 1528 so that the engagement of the worm 1524 with the worm gear 1522 is released. The worm gear 1522 is in the freely-rotating state. Depending on the actions of the sole springs 150 and the upper separation member 160, the left portion 110 and the right portion 120 are separated so that the shell is in the open state.

Moreover, the lock 152 also includes a controller which may control the power supply of the motor or the disengagement between worm 1524 with the worm gear 1522. For example, the controller may receive commands from the user wirelessly or by wires, so that the shell 100 is placed in the open state or closed state. In the situation of receiving commands wirelessly, for example, the controller is connected with the smart phone of the skier wirelessly and the skier can send commands to the controller for example by the Apps installed on the smart phone so as to allow the controller to control the operation of the lock. Therefore the shell 100 is placed in the open state or closed state. This is particularly convenient for those who are too fat to stoop down to use these ski boots. And the controller may send the real-time state of the ski boots to the smart phone of the skier so that the skier can easily check out through the smart phone.

Alarm

Figure 9:
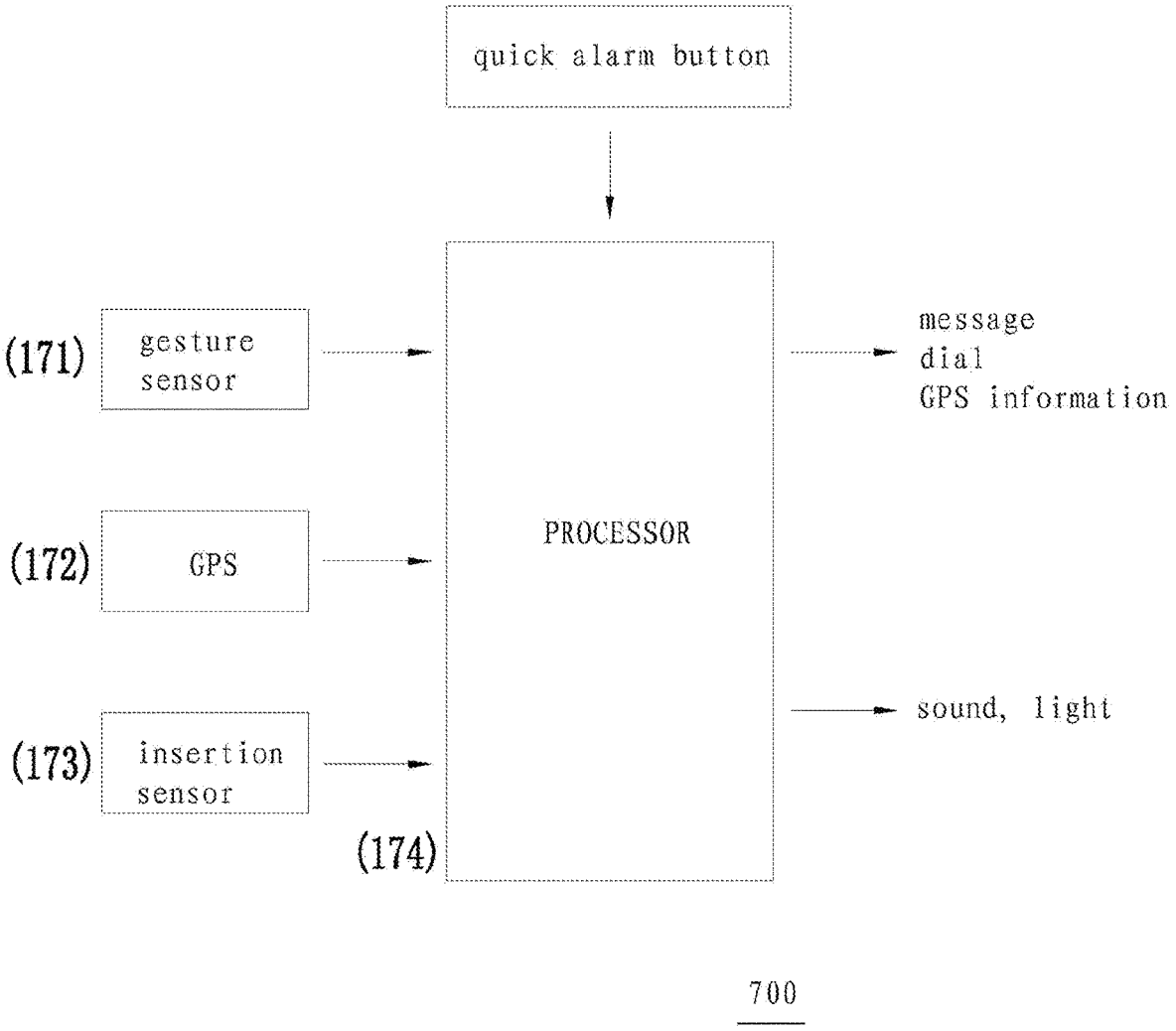
FIG. 9 shows a block diagram of a controller of the invention.

In one embodiment, as shown in FIG. 9, The shell 100 is also provided with an alarm 170 which may include a sensor 171 for sensing the gesture of the shell 100, such as a gyroscope; a sensor 172 for sensing the geographical position of the shell 100, such as a GPS sensor; a sensor 173 for sensing when the skier's foot (in situation that there is no liner) or the foot wearing a liner 200 inserted into the shell 100 which may be obtained by a pressure sensor or a temperature sensor; and a processor 174 configured for receiving the input from the sensor 173 to determine whether the shell 100 has already be worn by the skier, and determining the gesture of the shell when it determines that the shell 100 has already be worn by the skier, for example determining the angle of the shell 100 relative to the ground, wherein if the angle exceeds a threshold (for example 45 degrees) for a certain time period (for example 5 minutes), it determines that the skier has fallen off or been in danger and instructs the alarm 170 to report. The report may be achieved by sending a distress signal by antenna. Sending a distress signal includes sending a message or a Wechat message to a designated telephone number, sending the distress signal to the police; and sending the distress signal by sending a telegram, etc. The alarm may also include transmitting information about the GPS position of the shell 100; and activating a signal light and/or a speaker so as to make an audio and/or light alarm.

By providing the alarm 170, alarm information can be sent when the skier is in danger so as to locate the skier and perform rescue promptly.

Moreover, the alarm 170 may also include a quick report button so that the skier can press it when he realizes the risk and then send the information.

Furthermore, in the situation of the second embodiment of the lock 152, the processor 174 may be communicated with the controller or become a part thereof. Or, the controller may function as a processor 174. In this case, the skier may check the information on his current location, his previous path, etc. by the communication between the smart phone and the controller. The skier may also set up the alarm by his smart phone, for example, setting the emergency phone number, so that the alarm can send message or call for help to that number in case of danger.

Liner

Figure 5:
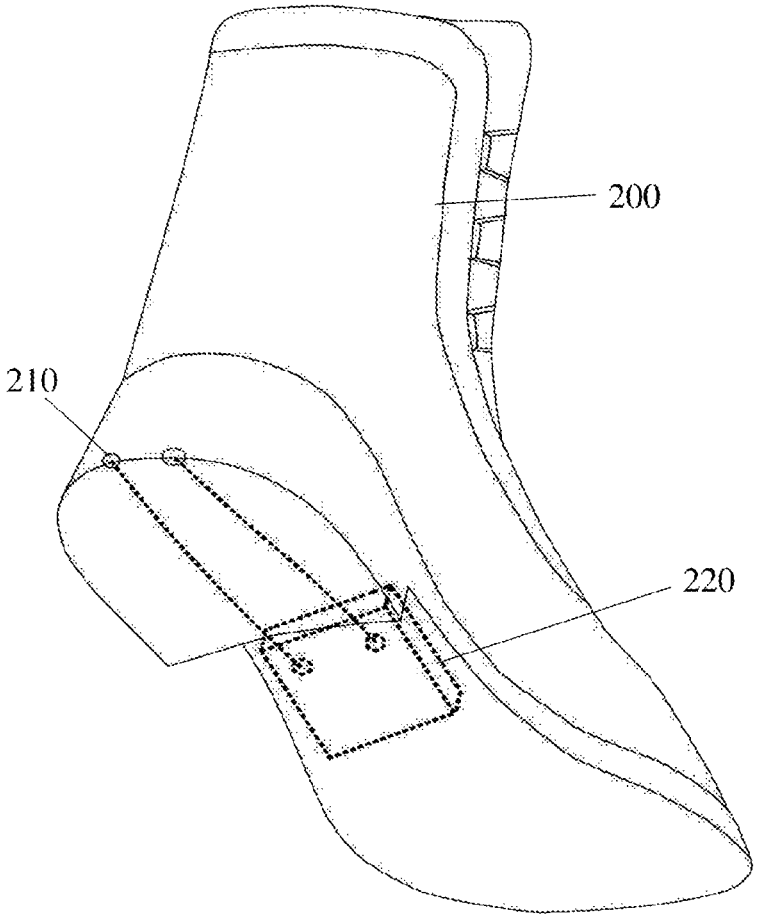
FIG. 5 shows a perspective view of a liner according to an embodiment of the invention.

Now the liner according to an embodiment of the invention will be explained with reference to FIG. 5.

The liner 200 comprises different soft lining materials so as to guarantee heat insulation, waterproofing and convenience. However, the sole of the liner may be made of stiff rubber or synthetic material so that the skier can merely wear the liner and walk on the snow or ground. Since there are big holes on the shell 100 so as to reduce the weight and thus the liner is exposed by the holes, the liner should be waterproof to some degree. Therefore, the liner may be made of waterproof materials. For example, the liner may be made of leather, Goretex, nylon, etc., and may have soft lining materials.

The liner 200 may also include a heater (not shown). For example, the heater includes heating wires embedded into the material of the liner 200. The liner 200 also includes a contact 210 arranged at the heel of the liner 200. When the liner 200 is inserted into the shell 100, the contact 210 may be contacted with a contact 181 (schematically shown in FIG. 11) at a corresponding position in the shell 100 so that the power supply on the shell 100 is connected with the heater of the liner 200 to make the heat work. Therefore the feet of the skier are provided with heat.

The battery may be a separate battery that is arranged on the shell 100. Or in the situation of the lock 152 according to the second embodiment of the invention, it may be a power supply in common with that of the lock 152. And the skier may for example input the liner temperature he wants by the smart phone. The controller may control the power supply of the battery to the heater based on the desired temperature so as to keep the liner temperature at a level that he skier wants.

Alternatively, a power supply 220 such as a rechargeable battery is provided on the liner 200, for example at the sole of the liner 200. The power supply may supply the heater of the liner 200 so as to turn it on manually before setting out to the ski track so that the power supply provides power to the liner 200, ensuring that the liner 200 is kept at a convenient temperature before the skier arrives at the ski track.

Upon arriving at the ski track, when the skier inserts the liner 200 into the shell, the contact on the liner 200 is connected with the corresponding contact on the shell 100. And in response to sensing the insertion of the liner 200 into the shell 100, power supply is switched from the power supply 220 of the liner 200 itself to the power supply 154 of the shell 100. The power supply of the shell 100 may supply the liner 200 under the control of the controller of the shell 100 so that the liner is kept at a proper temperature or a temperature set by the skier. Sensing the insertion of the liner 200 into the shell 100 may be achieved for example by a pressure sensor. When the pressure sensed by the pressure sensor is within a predetermined range, it is informed that the skier has already put on the liner 200 and the liner 200 has already been inserted into the shell 100. When the skier takes the liner 200 out of the shell 100, according to the signal from the pressure sensor, the shell 100 cuts off the power supply of the liner. The liner 200 switches to its own power supply depending on user's needs.

The Second Embodiment of the Ski Boot

The above describes a ski boot including the shell 100 and the liner 200. However, the ski boot according to the invention may not include the liner 200.

Figure 10:
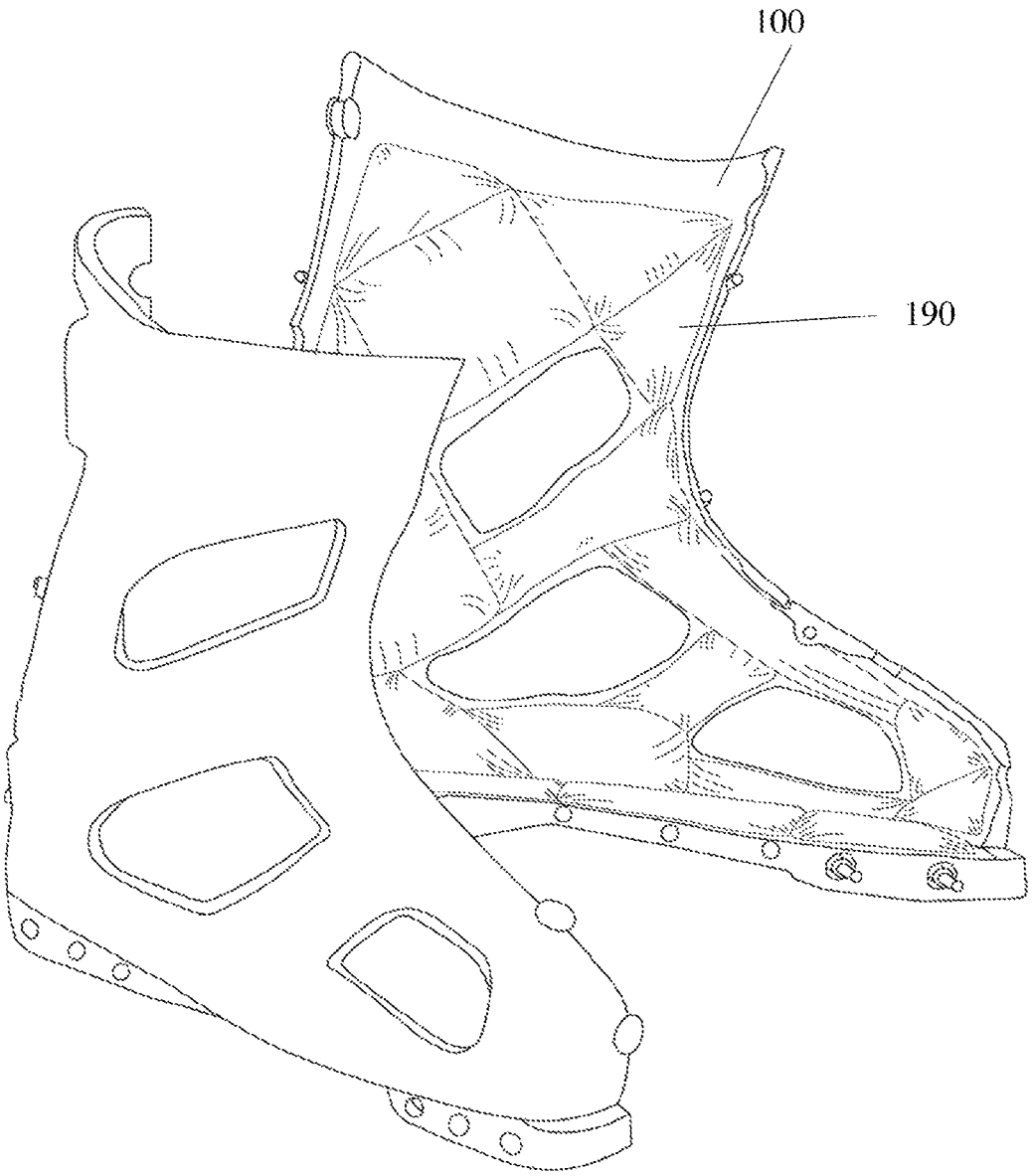
FIG. 10 shows a perspective view of a shell for a ski boot according to another aspect of the invention, in which an air bag is provided at the inside of the shell.

FIG. 10 shows the schematic view of the ski boot according to the second embodiment of the invention. It merely illustrates the differences between the ski boot according to the second embodiment and the above ski boot. Therefore, other details are not shown and repeated description is omitted.

For example, as shown in FIG. 10, an inflatable air bag 190 and an inflation pump (not shown) for its inflation are provided inside the shell 100. An inflation button (not shown) is provided on the shell 100 so that when the skier puts his foot into the shell, the inflation button is pressed to inflate the air bag 190 until the air bag 190 of the shell 100 expands to the extent that it fits the skier's foot. This kind of inflated shell acts as a ski boot. The size of the user, or even whether normal shoes are also worn at the same time, can be tolerated by the inflated shell. A power supply for the inflation pump is also provided on the shell 100. In the situation of the second embodiment of the lock 152, the power supply may be same with that of the lock. And the inflation pump may also be controlled by the controller so that the skier can control the inflation and deflation of the air bag by portable terminals such as a smart phone.

Alternatively, the above inflation pump may be a separate external inflation pump. An inflation port is provided on the shell 100 so that the nozzle of the external inflation pump is connected with the inflation port during inflation.

Ski

Figure 11:
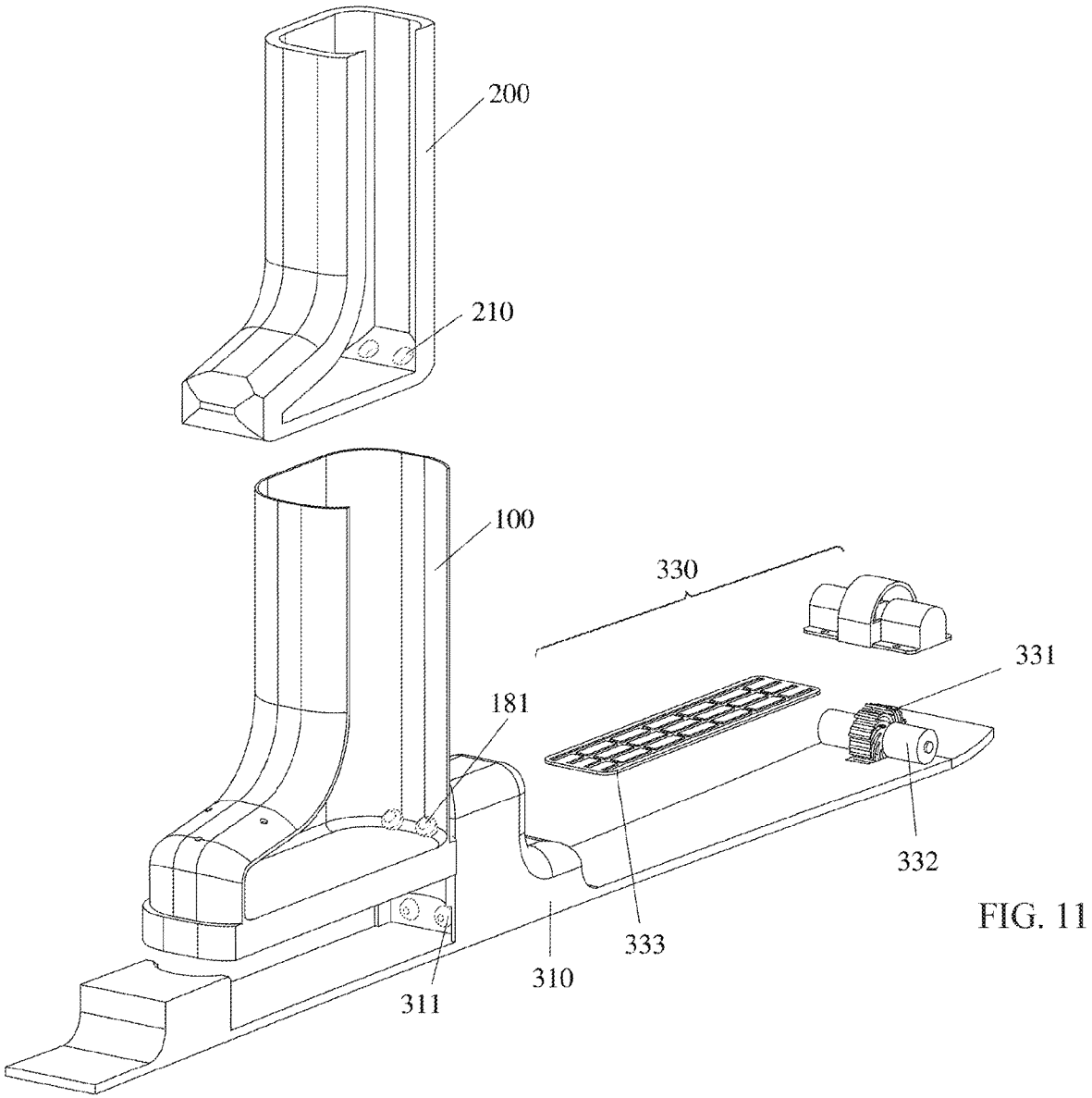
FIG. 11 shows a perspective view of ski equipment according to an embodiment of the invention.

According to the invention, a ski 300 cooperated with the ski boot is provided. As shown in FIG. 11, the ski 300 includes a catching portion 310 for catching the ski boot, a board portion 320 and an electricity generating portion 330 arranged on the board portion near its rear end. In one embodiment, the electricity generating portion 330 includes a friction wheel 331 and a generator 332. The periphery of the friction wheel 331 extends through an opening 321 of the board portion 320 so as to rub against the snow when the board portion 300 slides. Therefore, the friction wheel 331 is rotated so as to drive the generator 332 in rotation, making it possible to generate electricity. Additionally or alternatively, a solar battery panel is arranged on the board portion 320 so as to generate electricity under sunshine. A contact 311 is contained inside the catching portion 310. When the ski boot is caught on the ski, the contact 311 can contact with the corresponding contact on the shell 100 of the ski boot. Thus the electricity generated by the electricity generating portion 330 is delivered to the shell 100 so as to recharge the battery of the shell 100 or supply the consumers within the ski boot as a power supply. Those consumers may be for example the heater in the liner. Hence, during skiing, the heater can be supplied continuously so as to keep the liner's temperature, eliminating the need to consider the capacity of the battery carried by the shell.

Additionally, the electricity generating portion 330 is not limited to the generator or the solar battery panel. It may adopt for example a semiconductor-type electricity generating element which is contacted with the snow under the ski at one end and is arranged on the board portion at the other end. Electricity is generated by utilizing the temperature difference between the two sides.

The Operation of the Ski Boot

In the situation of the second embodiment of the lock 152, the ski boot according to the invention may be used according to the following method.

Figure 12:
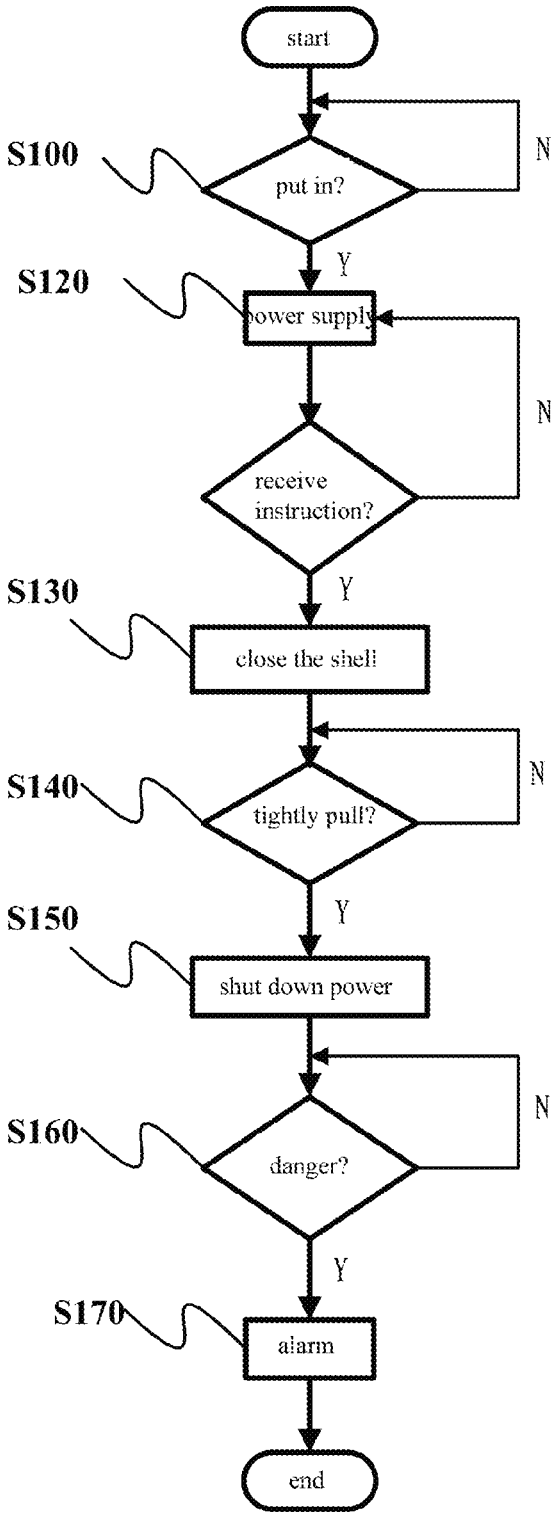
FIG. 12 shows a block diagram of the controlling method of the controller of the invention.

As shown in FIG. 12, the diagram is the flowchart for using the ski boot. The controller determines whether the skier has put the liner 200 into the shell 100 for example according to the signal from the pressure sensor or temperature sensor (S100). If yes, the controller triggers the alarm circuit, for example, it supplies power to the alarm circuit (S120). The controller receives commands from the skier which is for example transmitted to the controller by the skier's smart phone. Upon receipt of the command to close the shell, the controller supplies power to the motor of the lock 152 so as to activate the motor and then place the shell 100 into the closed state (S130). In case that the motor continuously pulls the cords 151 and 151' tight, the controller determines whether the cords 151 and 151' have been pulled tight which may be achieved by receiving signals from the sensor for determining such. The sensor may be for example a force sensor, a pressure sensor or a current sensor. When the pulling force of the cords sensed by the force sensor is larger than a predetermined value, or when the current of the motor sensed by the current sensor exceeds a predetermined value or the pressure between the left portion 110 and the right portion 120 of the shell is larger than a predetermined value, the controller determines that the cords 151 and 151' have been pulled tight and the shell has already been placed into closed state. Now the controller cuts off the current of the motor (S150). Now the skier may have the ski boot caught by the ski and start skiing. Also, the controller may receive signals for example from the GPS sensor and the gyroscope, and transmit the information indicating the skier's location and the gesture of the ski boot to the skier's smart phone so as to let the skier know his own skiing situation. The information may be displayed on the screen of the skier's smart phone or stored in the smart phone.

When the information from the gyroscope indicates that the ski boot has fallen down for a certain time period, for example the ski boot has fallen down at an angle of 45 degrees for more than 5 minutes, the controller determines that the skier falls down and is in danger (S160). The controller triggers the alarm to send the alarm signal, and send alarm information to designated phone number or destination. The alarm information may include Wechat, message and telegram, etc. The alarm signal may also include making sound or illumination (S170).

Although the above describes the preferred embodiment of the invention in detail, those skilled in the art may conceive various improvements and modifications in light of the above description. Therefore, the invention should not be limited to the above embodiments. The protection scope of the invention is merely defined by the attached claims and equivalents thereof.

What is claimed is:

1. A shell for a ski boot, the shell including a left portion and a right portion which are able to switch between a translation open state in which the left portion and the right portion are separated from each other by a distance and a closed state in which the left portion and the right portion are closed with each other, wherein in the translation open state, the left portion and the right portion are able to pivot relative to each other, wherein the shell also includes a locking mechanism and a separation bias device, wherein the locking mechanism is configured to keep the shell in the closed state and is able to be released so as to allow the shell to be placed in the translation open state, and wherein the separation bias device is configured to bias the left portion and the right portion toward the translation open state, wherein the left portion includes an upper left portion and a sole left portion, and the right portion includes an upper right portion and a sole right portion, wherein in the closed state, the upper left portion is engaged with the upper right portion and the sole left portion is engaged with the sole right portion, and in the translation open state, the upper left portion and the sole left portion are physically spaced from the upper right portion and the sole right portion by the distance, respectively, and wherein the separation bias device includes an upper spring provided between the upper left portion and the upper right portion so as to bias the upper left portion and the upper right portion in a direction of being away from each other.

2. The shell according to claim 1, wherein the upper spring is a torsion spring, two ends of which are fixed on the upper left portion and the upper right portion respectively.

3. The shell according to claim 2, wherein a plurality of locating members are arranged on a boundary between the upper left portion and the upper right portion in order to guarantee a correct alignment between the upper left portion and the upper right portion and provide the rigidity of the upper left portion and the upper right portion closed as a whole.

4. The shell according to claim 2, wherein locating members are arranged between the sole left portion and the sole right portion in order to guarantee a correct alignment between the sole left portion and the sole right portion and provide rigidity of the upper left portion and the upper right portion closed as a whole.

5. The shell according to claim 1, wherein the locking mechanism includes a lock and cords, wherein the lock is capable of locking the cords, and the cords surround the shell at a plurality of locations.

6. The shell according to claim 5, wherein the lock includes a double-sided ratchet wheel on which slots are arranged, wherein the double-sided ratchet wheel is able to rotate only in one direction so as to wind the cords so that the left portion and the right portion are closed, and wherein the locking of the double-sided ratchet wheel is releasable so that the double-sided ratchet wheel is able to freely rotate, placing the left portion and the right portion in the translation open state.

7. The shell according to claim 6, wherein it also includes a driving tool which is able to drive the double-sided ratchet wheel in rotation to wind in the cord.

8. The shell according to claim 6, wherein the lock includes a motor for driving the double-sided ratchet wheel in rotation to wind in the cords.

9. The shell according to claim 8, wherein the lock includes a controller to control an operation of the motor.

10. The shell according to claim 9, wherein the controller is in communication with a mobile terminal of a skier to receive commands therefrom.

11. The shell according to claim 10, wherein the commands include a command to close the shell.

12. The shell according to claim 6, wherein the lock also includes a release button, and wherein when the release button is triggered, the locking of the lock against the cords are released.

13. The shell according to claim 1, wherein the shell is equipped with an alarm.

14. The shell according to claim 13, wherein the alarm include a sensor for determining a geographical position of the shell, and a sensor for determining a gesture of the shell.

15. The shell according to claim 13, wherein the alarm is configured to send alarm information when a sensor for determining a gesture of the shell indicates that the shell has fallen down for more than a certain time period.

16. The shell according to claim 1, wherein a plurality of inflatable air bags are provided inside the shell.

17. A ski boot including a shell according to claim 1 and a liner which is able to put into the shell and taken out of it.

18. The ski boot according to claim 17, wherein the liner also includes a heater to heat the liner.

19. The shell according to claim 1, wherein the separation bias device further includes a sole spring provided between the sole left portion and the sole right portion so as to bias the sole left portion and the sole right portion in a direction of being away from each other.

20. The shell according to claim 19, wherein the sole spring includes a coil spring which is compressed between the sole left portion and the sole right portion in the closed state.

* * * * *